United States Patent [19]

Watanabe et al.

[11] Patent Number: 4,959,023

[45] Date of Patent: Sep. 25, 1990

[54] ELECTRICAL CONNECTOR

[75] Inventors: Hiroshi Watanabe; Katsuaki Terada, both of Shizuoka, Japan

[73] Assignee: Yazaki Corporation, Tokyo, Japan

[21] Appl. No.: 389,147

[22] Filed: Aug. 3, 1989

[30] Foreign Application Priority Data

Aug. 8, 1988 [JP] Japan ..... 63-196124

[51] Int. Cl.[5] ..... H01R 13/40

[52] U.S. Cl. ..... 439/595; 439/594; 439/598

[58] Field of Search ..... 439/594, 595, 598

[56] References Cited

U.S. PATENT DOCUMENTS

| | | | |
|---|---|---|---|
| 3,501,736 | 3/1970 | Norris | 339/91 |
| 4,557,542 | 12/1985 | Coller et al. | 439/595 |
| 4,758,182 | 7/1988 | Anbo et al. | 439/598 |

*Primary Examiner*—Paula A. Bradley

*Attorney, Agent, or Firm*—Sughrue, Mion, Zinn, Macpeak & Seas

[57] ABSTRACT

An electrical connector includes an electrically-insulative housing having front and rear open ends and at least one terminal-receiving chamber. The housing has a slot therein adjacent to the front open end thereof. At least one contact terminal is inserted into the chamber from the rear open end of the housing. A spacer is inserted into the slot in such a manner that the spacer can be slidingly moved to a final locked position in a direction perpendicular to the axis of the contact terminal. The spacer has a terminal-retaining portion which engages the contact terminal in the locked position of the spacer to thereby prevent the contact terminal from being withdrawn from the chamber.

9 Claims, 4 Drawing Sheets

ELECTRICAL CONNECTOR

BACKGROUND OF THE INVENTION

1. Field of the Invention

This invention relates to an electrical connector having a double retaining mechanism for preventing electrical terminals from being withdrawn from a connector housing.

2. Prior Art

In an electrical connector used to make a connection between wire harnesses or a connection between a wire harness and electrical equipment, each terminal inserted into an electrically-insulative housing of the connector is retained against disengagement or withdrawal therefrom, by either a so-called case lance or a terminal lance. However, the retaining force applied by such retaining means is not sufficient. Particularly, it is imperative from a safety standpoint to avoid incomplete insertion of a terminal into a connector housing and to avoid disengagement of the terminal therefrom in an automobile which is running and is subjected to vibration. For this reason, recently, electrical connectors having a double retaining mechanism have been increasingly used.

Japanese Laid-Open (Kokai) Utility Model Application No. 109887/76 discloses one such electrical connector in which an insertion hole is formed through a plug body (insulative housing) containing contact terminals, and an insertion pin is inserted into the insertion hole so that the peripheral surface of the insertion pin is engaged with a shoulder formed on a contact portion of the contact terminal engageable with its mating terminal, thereby achieving a double retention of the terminal.

With this construction, however, regardless of whether the insertion pin is inserted into the insertion hole or not, the female and male terminals can be engaged with each other, and therefore there is a risk that the electrical connector may be used without attaching the insertion pin to the plug body or housing, thus failing to provide an intended double retaining of the electrical terminals.

SUMMARY OF THE INVENTION

With the above deficiencies of the prior art in view, it is an object of this invention to provide an electrical connector of the type which is provided with a spacer for eliminating incomplete insertion of a terminal and thereby positively achieving a double retaining of the terminal, and which cannot be engaged with a mating connector unless the spacer is attached to the electrical connector.

According to the present invention, there is provided an electrical connector comprising:

an electrically-insulative housing having front and rear open ends and at least one terminal-receiving chamber, said housing having a slot therein adjacent to said front open end thereof;

at least one contact terminal inserted into said chamber from said rear open end of said housing; and a spacer inserted into said slot in such a manner that said spacer can be slidingly moved to a locked position in a direction perpendicular to the axis of said contact terminal, said spacer having a terminal-retaining portion which engages said contact terminal in said first position of said spacer to thereby prevent said contact terminal from being withdrawn from said chamber.

DESCRIPTION OF THE PREFERRED EMBODIMENTS OF THE INVENTION

Figure 1:
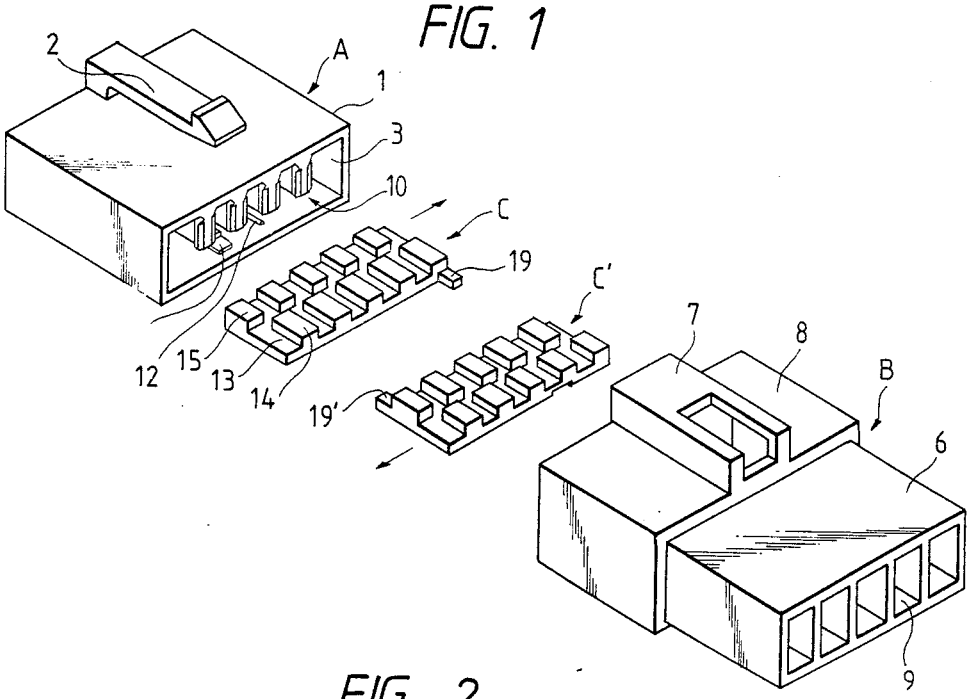
FIG. 1 is a perspective view of a pair of mating electrical connectors in their disassembled condition, provided in accordance with the present invention.

The invention will now be described with reference to the drawings.

In FIGS. 1 to 5, reference character A denotes a male connector, reference character B a female connector, and reference characters C and C′ double-retaining spacers for retaining contact terminals.

Figure 5:
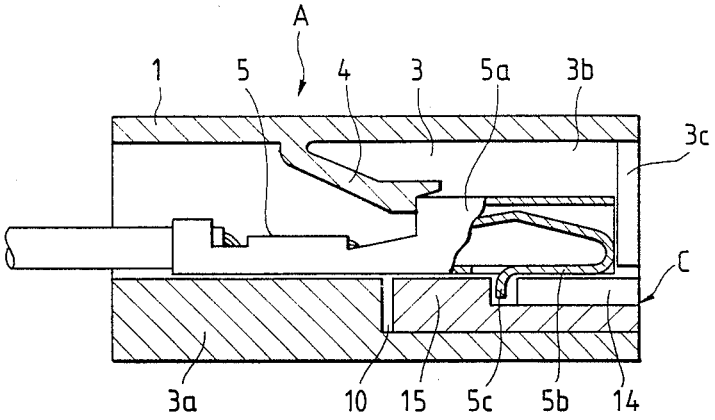
FIG. 5 is a cross-sectional view of the connector, showing double retention of a contact terminal by the spacer.

The connector A comprises an electrically-insulative housing 1 having a lock arm 2 on an outer surface thereof, and a plurality of terminal-receiving chambers 3 formed in the interior of the housing 1 in juxtaposed relation. A flexible retainer arm 4 is formed on the upper wall of each chamber 3 and extends therefrom toward an open front end of the chamber 3. As shown in FIG. 5, contact terminals 5 of the female type are inserted into the terminal-receiving chambers 3, respectively, each contact terminal 5 having a contact portion 5*a* engageable with its mating male terminal received in the connector B. Each retainer arm 4 engages a shoulder, formed on the contact portion 5*a* of the female terminal 5, so as to prevent the withdrawal of the contact terminal 5 from the chamber 3. The connector B comprises an electrically-insulative housing 6 including a cross-sectional rectangular portion 8 which has at its outer surface a retainer portion 7 engageable with the lock arm 2. The housing 6 has a plurality of terminal-receiving chambers 9, and male terminals (not shown) are received in the terminal-receiving chambers 9, respectively.

Figure 2:
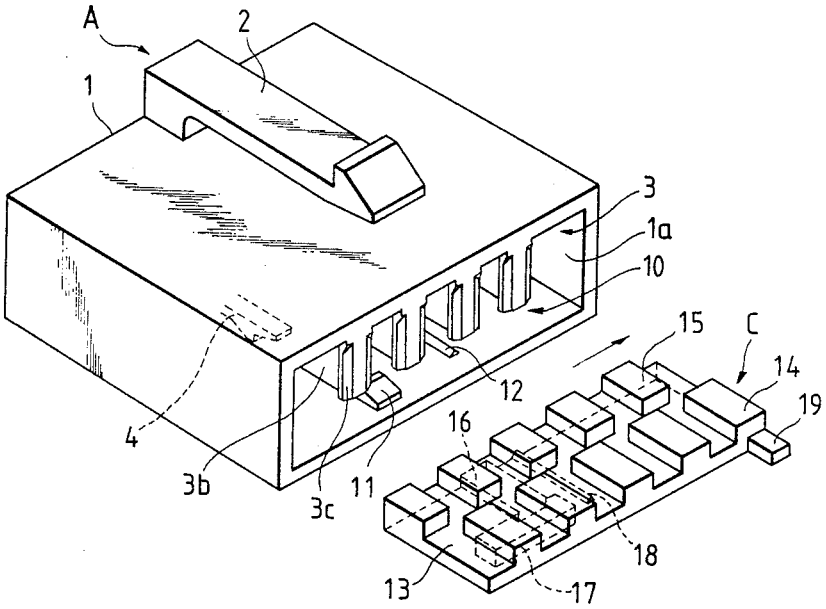
FIG. 2 is an enlarged perspective view of one of the mating electrical connectors.
Figure 3:
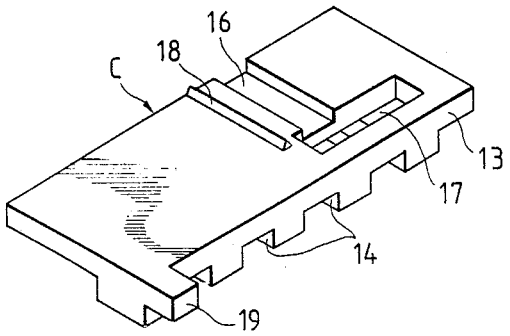
FIG. 3 is a perspective view of a spacer as viewed from its bottom side.
Figure 4A:
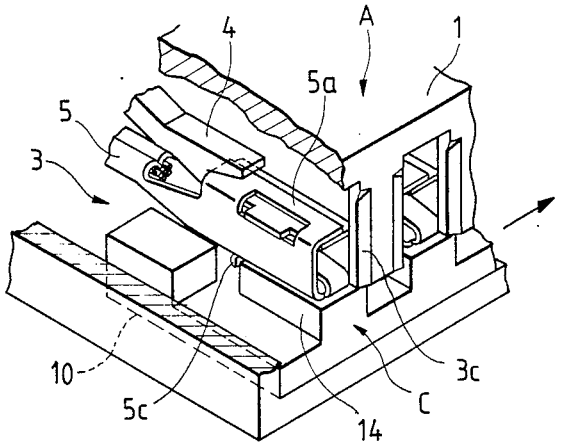
FIGS. 4(*a*) and 4(*b*) are partly-broken, perspective views of a portion of the connector, showing the operation of the spacer.
Figure 4B:
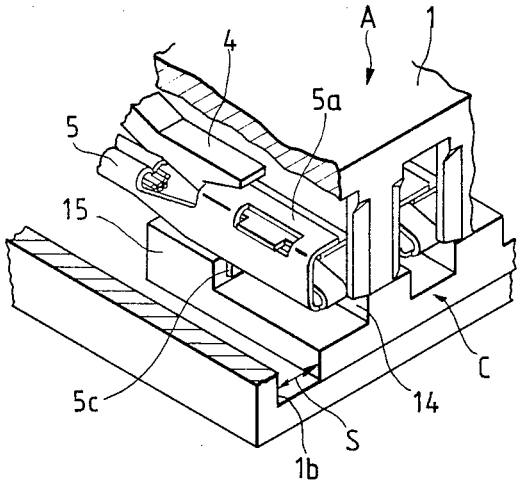

As shown in FIG. 5, a slot or recess 10 is transversely formed in a bottom wall 3*a* of the insulative housing 1 and is disposed adjacent to the open front end of the housing 1, the slot 10 extending across partition walls 3*b* dividing the interior of the housing 1 into the plurality of terminal-receiving chambers 3. The spacer C is designed to be received in the slot 10 and can be slidingly moved transversely of the housing 1 as indicated by an arrow (FIGS. 1, 2 and 4). As best shown in FIG. 2, a spacer-retaining pawl 11 and a reverse slide-prevention ridge 12 of a semi-circular cross-section are forced on the bottom of the slot 10, the pawl 11 and the ridge 12 both extending in the axial direction of the contact terminals 5. Front stop walls 3c are formed on the partition walls 3b for abutment with the front ends of the terminals 5.

The spacer C includes a plate-like body 13 which has a plurality of pairs of terminal-retaining portions 14 and 15 formed on an upper surface thereof so as to correspond to the terminal-receiving chambers 3, respectively. A guide groove 16 for receiving the spacer retaining pawl 11 is formed in the lower surface of the spacer body 13, and a retaining groove 17 extending perpendicular to the guide groove 16 is also formed in the lower surface of the spacer body 13. A ridge 18 for engagement with the ridge 12 is also formed on the lower surface of the spacer body 13. A lock-confirming tongue 19 is formed on the front side or edge of the spacer body 13 at the corner thereof. The terminal-retaining portions 14 and 15 serve to prevent the backward and forward movements of the contact terminal 5 relative to the housing 1, respectively. The terminal-retaining portion 14 is disposed forwardly and generally diagonally with respect to the terminal-retaining portion 15. A base plate section 5b of the contact portion 5a of the contact terminal 5 has a retainer tongue 5c (FIGS. 4 and 5) for engagement with the terminal-retaining portions 14 and 15.

The spacer C' for the connector B is identical in construction to the spacer C, and therefore its explanation is omitted.

The manner of using the spacer C will now be described.

As shown in FIG. 4(*a*), the spacer C is first inserted into the slot 10 of the insulative housing 1 of the connector A. This insertion of the spacer C can be smoothly carried out by a guiding action between the spacer-retaining pawl 11 and the guide groove 16 (see FIGS. 2 and 3). Upon engagement of the spacer-retaining pawl 11 in the retaining groove 17, the spacer C is retained in this inserted position.

In this condition, when the contact terminal 5 is inserted into the terminal-receiving chamber 3, the flexible retainer arm 4 is engaged with the shoulder on the contact portion 5a, so that a primary retaining of the terminal 5 by the above-mentioned retainer arm is made. Also, the front end of the contact portion 5a of the contact terminal 5 abuts against the front stop wall 3c, and the terminal-retaining portion 14 of the spacer C engages the front face of the retainer tongue 5c, so that a further forward movement of the contact terminal 5 is completely prevented.

Then, the spacer C is slidingly moved in the direction of the arrow, so that the ridge 18 slides over the ridge 12, and then the spacer body 13 is brought into abutting engagement with one side inner wall 1a (FIG. 2) of the insulative housing 1, thus locking the spacer C in this locked position.

In this locked position of the spacer C, as shown in FIGS. 4(*b*) and 5, the terminal-retaining portion 15 engages the rear face of the retainer tongue 5c, thereby achieving a secondary retaining of the contact terminal 5. Thus, the combination of the aforesaid primary retaining and the secondary retaining positively prevents the withdrawal of the contact terminal 5 from the terminal-receiving chamber 3.

Also, as a result of the sliding movement of the spacer C to its locked position, a space S (FIG. 4b) for receiving a lock-confirming tongue 19' of the spacer C' is formed between the spacer body 13 and the other side inner wall 1b of the insulative housing 1.

As can be clearly seen from FIG. 4(*b*), if the insertion of the contact terminal 5 into the receiving chamber 3 is inadequate, the retainer tongue 5c serves as a stopper relative to the terminal-retaining portion 15, thereby prohibiting the sliding movement of the spacer C, and therefore the space S is not obtained, so that a proper engagement between the two connectors A and B cannot be made.

Therefore, incomplete attachment of the contact terminals 5 and the spacer C relative to the housing 1 is checked and prevented, and a double retaining of the terminals 5 can be positively carried out.

Figure 6:
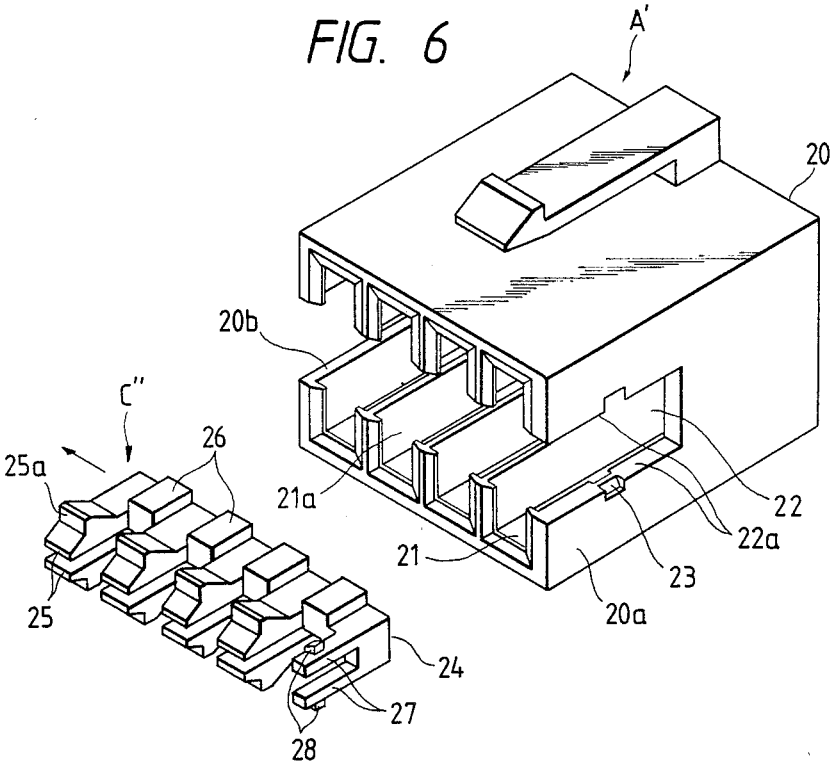
FIG. 6 is a perspective view of a modified electrical connector in its disassembled condition.
Figure 7A:
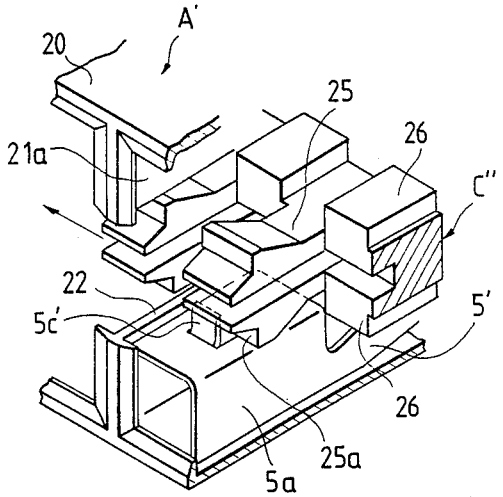
FIGS. 7(*a*) and 7(*b*) are partly-broken, perspective views of the electrical connector of FIG. 6, slowing the operation of a spacer.
Figure 7B:
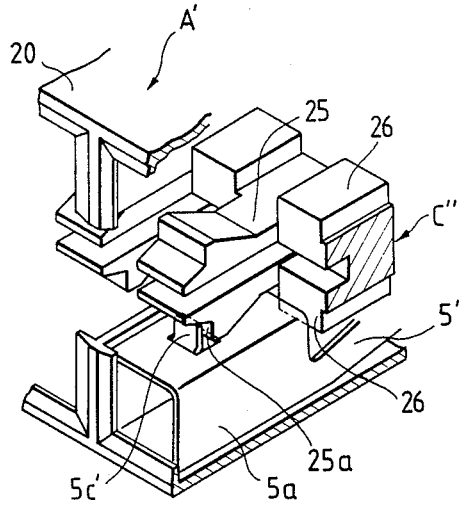
Figure 8:
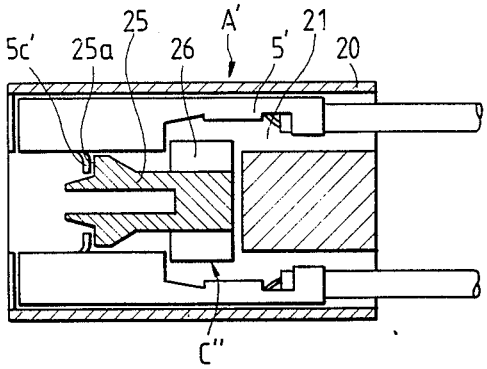
FIG. 8 is a cross-sectional view of the electrical connector of FIG. 6, showing double retention of contact terminals by the spacer.

FIGS. 6 to 8 show a modified form of the invention. In this embodiment, the spacer performs the functions of the primary and secondary retaining of the terminals.

More specifically, an insulative housing 20 of an electrical connector A' of the male type has a plurality of upper and lower terminal-receiving chambers 21, the upper chambers being disposed in registry with the lower chambers, respectively. A slot 22 is formed in the housing 20 in its transverse direction, the slot 22 extending through opposite side walls 20a and 20b of the housing 20 and partition walls 21a. A pair of opposed lock tongues 23 of a triangular cross-section are formed on an edge 22a of an opening formed through the side wall 20a and defining one end of the slot 22.

The spacer C'' includes an elongated body 24 having flexible retainer arms 25 arranged in upper and lower rows at its front, the juxtaposed flexible retainer arms 25 corresponding to the terminal-receiving chambers 21, respectively. Two rows of terminal-retaining portions 26 are formed on the upper and lower surfaces of the spacer body 24, respectively. The spacer body 24 has at one end a pair of opposed lock arms 27 having lock pawls 28 for engagement with the lock tongues 23, respectively. Each terminal-retaining portion 26 is disposed rearwardly of its mating flexible retainer arm 25 and is generally diagonally positioned with respect thereto. Each flexible retainer arm 25 has an engaging step portion 25a sufficiently greater in width than a retainer tongue 5c' (later described) of a contact terminal 5'.

The contact terminal 5, of the female type to be inserted into the connector A' has the retainer tongue 5c' formed on its contact portion 5a by stamping, as shown in FIGS. 7(*a*), 7(*b*) and 8.

In this embodiment, the terminal-receiving chamber 21 of the insulative housing 20 is not provided with retaining means for retaining the contact terminal 5', and therefore the terminal cannot be retained within the terminal-receiving chamber 21 unless the spacer C'' is attached to the housing 20.

More specifically, in FIG. 6, when the spacer C'' is inserted into the slot 22 from the front end of the insulative housing 20, the lock pawls 28 of the lock arms 27 engage the outer inclined surfaces of the lock tongues 23, respectively, to thereby retain the spacer C''.

In this condition, when the contact terminal 5' is inserted into the terminal-receiving chamber 21 from its open rear end, the retaining step portion 25a of the flexible retainer arm 25 engages the rear face of the retainer tongue 5c', as in an ordinary case lance, thereby achieving a primary retaining of the terminal.

After all the contact terminals 5' are inserted into the housing 1, the spacer C'' is slidingly moved in a direction of an arrow (see FIGS. 6 and 7) to its locked position, so that each terminal-retaining portion 26 is moved to a position where it engages the rear face of the contact portion 5*a* of the contact terminal 5, as shown in FIGS. 7(*b*) and 8, while maintaining the above-mentioned primary retaining condition, thereby achieving a secondary retaining of each terminal.

As can be clearly seen from FIG. 7(*b*), if any one of the contact terminals 5' is incompletely inserted into the connector A', the contact portion 5*a* serves as a stopper relative to the terminal-retaining portion 26, so that the spacer C'' cannot be slidingly moved, thus detecting such incomplete insertion and preventing it.

When the spacer C'' is slidingly moved to its locked position as described above, the lock pawls 28 slide over the lock tongues 23, respectively, and are brought into engagement with the inner inclined surfaces of the lock tongues 23, respectively, thereby locking the spacer C''. In this embodiment, since the spacer C'' is provided with the flexible retainer arms 25 for the primary retaining of the contact terminals 5', the construction within each terminal-receiving chamber 21 is simplified, and the molding of the insulative housing 1, made of a resin, can be carried out more easily.

The spacers C, C', C'' are designed to be inserted into the slots 10, 22 provided at the open front end of the housings 1, 20, and are designed to be locked or retained both at their inserted positions and at their locked positions.

The sliding movement of the spacer cannot be carried out unless a complete insertion of the contact terminal 5, 5' is made, because the terminal retaining portion 15, 26 interferes with the retainer tongue 5*c* or the side of the contact portion 5*a* of the contact terminal. Thus, such incomplete insertion of the terminal and the prevention thereof are simultaneously achieved. In other words, when the spacer is in its locked position, the double retaining of the terminal can be effected positively.

Further, if the spacer C is not locked in its locked position, the lock-conforming tongues 19 and 19' will not permit further connection with the mating connector terminals in the housing B. If the spacer C'' is not inserted into the housing A', the contact terminal 5' is not properly inserted and retained, and therefore the two mating electrical connectors cannot be properly engaged with each other and connected together.

As described above, according to the electrical connector of the present invention, an incomplete insertion of the contact terminal into the housing can be prevented, and the double retaining of the contact terminal can be positively made, thus ensuring that the electrical connection of the connector with its mating connector can be made in a highly reliable manner.

What is claimed is:

1. An electrical connector comprising:

an electrically-insulative housing having front and rear open ends and at least one terminal-receiving chamber, said housing having a slot therein adjacent to said front open end thereof;

at least one contact terminal inserted into said chamber from said rear open end of said housing; and a spacer inserted into said slot in such a manner that said spacer can be slidingly moved perpendicularly to the axis of said contact terminal to a locked position, said spacer having a terminal-retaining portion which engages said contact terminal when said spacer is in said locked position to thereby prevent said contact terminal from being withdrawn from said chamber, in which said spacer has a lock-confirming tongue at a front corner portion thereof, said lock-confirming tongue being adapted to be engaged with a spacer inserted into an open front end of a mating connector, the lock-confirming tongue being received in a space formed between the spacer of the mating connector and an inner wall of the mating connector, and when one of said spacer and the spacer of the mating connector is not disposed in their respective locked positions, the engagement between the two connectors being prevented.

2. An electrical connector for receiving and retaining a contact terminal adapted to be inserted into said electrical connector, comprising:

a housing having a rear open end and a front open end and partitions for dividing said housing into slots for receiving and retaining contact terminals through said rear open end;

a spacer shaped to be inserted in said housing through said front open end;

means on said spacer and said housing for guiding said spacer in said housing to a locked position thereon; and retention means on said spacer for blocking the withdrawal of contact terminals from said slots when said spacer is in its locked position, wherein said retention means comprises a first row of retention blocks on a surface of said spacer, each said retention block being positioned to block withdrawal of a respective contact terminal from a respective slot when said spacer is in its locked position, and further comprising a second row of blocks on said spacer positioned rearwardly and diagonally with respect to the retention blocks; said second row of blocks acting as stoppers during the insertion of contact terminals into said slots.

3. An electrical connector as claimed in claim 2, further comprising: retaining arms positioned in said slots, respectively, for additionally retaining the respective contact terminals inserted into said slots.

4. An electrical connector for receiving and retaining a contact terminal adapted to be inserted into said electrical connector, comprising:

a housing having a rear open end and a front open end and partitions for dividing said housing into slots for receiving and retaining contact terminals through said rear open end;

a spacer shaped to be inserted in said housing through said front open end;

means on said spacer and said housing for guiding said spacer in said housing to a locked position thereon; and retention means on said spacer for blocking the withdrawal of contact terminals from said slots when said spacer is in its locked position, further comprising: retaining arms positioned in said slots, respectively, for additionally retaining the respective contact terminals inserted into said slots, wherein said retention means comprises a first row of retention blocks on a surface of said spacer, each said retention block being positioned to block withdrawal of a respective contact terminal from a respective slot when said spacer is in its locked position, and wherein said guiding means comprises a track on a surface of said spacer opposite to said retention blocks, and a pawl on a bottom of said housing for riding in said track; said track having substantially an L shape for guiding said spacer initially in an insertion direction and subsequently in a transverse direction.

5. An electrical connector as claimed in claim 4, further comprising a second row of blocks on said spacer positioned rearwardly and diagonally with respect to the retention blocks; said second row of blocks acting as stoppers during the insertion of contact terminals into said slots.

6. An electrical connector as claimed in claim 5, wherein said contact terminals are of a type having a lip extending downward therefrom; said spacer and the two rows of blocks positioned thereon being arranged such that when said spacer is inserted, but not moved transversely to its locked position, the contact terminals can be inserted and stopped by said lips abutting said blocks of said second row; and when said spacer is moved to its locked position, the blocks in said second row abut said lips to retain said contact terminals.

7. An electrical connector as claimed in claim 6, wherein the separation of said first and second rows of blocks is sufficient to allow transverse movement of said spacer despite the presence of contact terminals only if said contact terminals are fully inserted so that the lips ride in the said separation of said rows of blocks.

8. An electrical connector for receiving and retaining a contact terminal adapted to be inserted into said electrical connector, comprising:

a housing having a rear open end and a front open end and partitions for dividing said housing into slots for receiving and retaining contact terminals through said rear open end;

a spacer shaped to be inserted in said housing through said front open end;

means on said spacer and said housing for guiding said spacer in said housing to a locked position thereon; and retention means on said spacer for blocking the withdrawal of contact terminals from said slots when said spacer is in its locked position, wherein said retention means comprises two retaining elements per contact terminal, a first said retaining element being a block positioned on said spacer to allow insertion of said contact terminals when said spacer is in an inserted position but is not in said locked position, and to block withdrawal of contact terminals when said spacer is in its locked position.

9. An electrical connector as claimed in claim 8, wherein a second retaining element is a flexible retaining arm extending toward the front end of said housing and flexing as said contact terminal is inserted and abutting a shoulder of said contact terminal after insertion thereof to provide additional retention of said contact terminal.

* * * * *